US008540024B2

(12) United States Patent
Kosarev et al.

(10) Patent No.: US 8,540,024 B2
(45) Date of Patent: Sep. 24, 2013

(54) PERFORATION STRATEGY FOR HETEROGENEOUS PROPPANT PLACEMENT IN HYDRAULIC FRACTURING

(75) Inventors: Ivan Vitalievich Kosarev, Dolgoprudny (RU); Oleg Olegovich Medvedev, Odessa (UA); Anatoly Vladimirovich Medvedev, Moscow (RU); Ian Walton, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 628 days.

(21) Appl. No.: 12/667,073

(22) PCT Filed: Jul. 3, 2007

(86) PCT No.: PCT/RU2007/000357

§ 371 (c)(1),
(2), (4) Date: Oct. 28, 2010

(87) PCT Pub. No.: WO2009/005387

PCT Pub. Date: Jan. 8, 2009

(65) Prior Publication Data

US 2011/0036571 A1 Feb. 17, 2011

(51) Int. Cl.
*E21B 43/267* (2006.01)

(52) U.S. Cl.
USPC ..... 166/280.2; 166/280.1; 166/297; 166/308.1; 507/924

(58) Field of Classification Search
None
See application file for complete search history.

(56) References Cited

U.S. PATENT DOCUMENTS

| | | | | |
|---|---|---|---|---|
| 3,592,266 | A | 7/1971 | Tinsley | |
| 3,659,651 | A | 5/1972 | Graham | |
| 3,664,420 | A * | 5/1972 | Graham et al. | 166/280.2 |
| 3,701,383 | A | 10/1972 | Richardson et al. | |
| 3,850,247 | A | 11/1974 | Tinsley | |
| 3,888,311 | A | 6/1975 | Cooke, Jr. | |
| 4,029,149 | A | 6/1977 | Perkins | |
| 4,143,715 | A | 3/1979 | Pavlich | |
| 4,665,990 | A | 5/1987 | Perlman | |
| 5,330,005 | A | 7/1994 | Card et al. | |

(Continued)

FOREIGN PATENT DOCUMENTS

| | | |
|---|---|---|
| EP | 0771935 | 5/1997 |
| EP | 1267034 | 12/2002 |

(Continued)

OTHER PUBLICATIONS

E.L. Cussler, Diffusion: Mass Transfer in Fluid Systems, Cambridge University Press, pp. 89-93 (1984).

(Continued)

*Primary Examiner* — George Suchfield
(74) *Attorney, Agent, or Firm* — Daryl Wright; Robin Nava; Tim Curington

(57) ABSTRACT

Hydraulic fracturing an individual reservoir fracturing layer of a subterranean formation to produce heterogeneous proppant placement is given in which pillars of proppant are placed such that the pillars do not extend the entire height of the fracture (for a vertical fracture) but are themselves interrupted by channels so that the channels between the pillars form pathways that lead to the wellbore. The method combines methods of introducing slugs of proppant-carrying and proppant-free fluids through multiple clusters of perforations within a single fracturing layer of rock, with methods of ensuring that the slugs exiting the individual clusters do not merge.

44 Claims, 5 Drawing Sheets

(56) References Cited

U.S. PATENT DOCUMENTS

| | | | | |
|---|---|---|---|---|
| 5,411,091 | A | 5/1995 | Jennings | |
| 5,597,043 | A * | 1/1997 | Stadulis | 166/280.1 |
| 6,114,410 | A | 9/2000 | Betzold | |
| 6,328,105 | B1 | 12/2001 | Betzold | |
| 6,776,235 | B1 | 8/2004 | England | |
| 7,938,185 | B2 * | 5/2011 | Smith et al. | 166/280.1 |
| 2003/0230408 | A1 | 12/2003 | Acock et al. | |
| 2004/0224155 | A1 | 11/2004 | Barron et al. | |
| 2004/0261995 | A1 | 12/2004 | Nguyen et al. | |
| 2005/0126780 | A1 | 6/2005 | Todd et al. | |
| 2005/0130848 | A1 | 6/2005 | Todd et al. | |
| 2005/0274523 | A1 | 12/2005 | Brannon | |
| 2006/0035790 | A1 | 2/2006 | Okell et al. | |
| 2006/0048944 | A1 * | 3/2006 | van Batenburg et al. | 166/308.1 |
| 2006/0113078 | A1 | 6/2006 | Nguyen | |
| 2006/0113080 | A1 | 6/2006 | Nguyen | |
| 2007/0029086 | A1 | 2/2007 | East, Jr. | |
| 2007/0131424 | A1 | 6/2007 | Fripp | |
| 2008/0149329 | A1 * | 6/2008 | Cooper et al. | 166/250.01 |
| 2008/0271890 | A1 * | 11/2008 | Smith et al. | 166/280.1 |
| 2009/0044945 | A1 * | 2/2009 | Willberg et al. | 166/308.1 |

FOREIGN PATENT DOCUMENTS

| | | |
|---|---|---|
| SU | 874997 | 10/1981 |
| SU | 953190 | 8/1982 |
| WO | 00/49272 | 8/2000 |
| WO | 2004/009956 | 1/2004 |
| WO | 2005/000993 | 1/2005 |

OTHER PUBLICATIONS

Extended Supplementary European Search Report for the equivalent European Patent Application No. 07861021.9 issued on Apr. 22, 2013.

"Reservoir Stimulation" 3rd Ed., M.J. Economides, K.G. Nolte, Editors, John Wiley and Sons, New York, 2000.

J.M. Tinsley, et al, "A New Method for Providing Increased Fracture Conductivity and Improving Stimulation Results," SPE paper 4676, 1975.

Intensifikatsiya dobychi nefti I gaza metodom razryva plasta. Razrabotka I ekspluatatsiya gazovykh I gazokondensatnykh mestorozhdeny. Gazovaya promyshlennost, Obzornaya informatsiya, vyp. 1, Koskva, VNIIOENG, 1987 pp. 26-27.

Written Opinion of the International Search Authority for the equivalent PCT patent application No. PCT/RU2007/000357 issued on Apr. 3, 2008.

Granting Decision for the equivalent Russian patent application No. 2009149428 issued on Feb. 5, 2013.

* cited by examiner

PERFORATION STRATEGY FOR HETEROGENEOUS PROPPANT PLACEMENT IN HYDRAULIC FRACTURING

CROSS-REFERENCE TO RELATED APPLICATIONS

This application claims the benefit of PCT/RU2007/000357, filed on Jul. 3, 2007, which is incorporated herein by reference in its entirety.

BACKGROUND

The statements in this section merely provide background information related to the present disclosure and may not constitute prior art.

The invention relates to production of fluids from subterranean formations. More particularly, it relates to stimulation of flow through formations by hydraulic fracturing. Most particularly, it relates to methods of optimizing fracture conductivity by propping fractures in a formation stratum so that the proppant is distributed heterogeneously in the fracture, and in some embodiments, the fracture containing substantial voids with little or no proppant.

Hydraulic fracturing is a primary tool for improving well productivity by placing or extending highly conductive fractures from the wellbore into the reservoir. Conventional hydraulic fracturing treatments generally are pumped in several distinct stages. During the first stage, normally referred to as the pad, a fluid is injected through a wellbore into a subterranean formation at high rates and pressures. The fluid injection rate exceeds the filtration rate (also called the leakoff rate) into the formation, producing increasing hydraulic pressure. When the pressure exceeds a threshold value, the formation cracks and fractures. The hydraulic fracture initiates and starts to propagate into the formation as injection of fluid continues.

During the next stage, proppant is mixed into the fluid, which is then called the fracture fluid, frac fluid, or fracturing fluid, and transported throughout the hydraulic fracture as it continues to grow. The pad fluid and the fracture fluid may be the same or different. The proppant is deposited in the fracture over the designed length, and mechanically prevents the fracture from closure after injection stops and the pressure is reduced. After the treatment, and once the well is put on production, the reservoir fluids flow into the fracture and filter through the permeable proppant pack to the wellbore. The production of reservoir fluids depends upon a number of parameters, such as formation permeability, proppant pack permeability, hydraulic pressure in the formation, properties of the production fluid, the shape of the fracture, etc. One of the most essential parameters and one that can be designed, controlled and adjusted in hydraulic fracturing is the hydraulic conductivity of the fracture (the proppant pack permeability multiplied by the fracture width). There are numerous cases in which an increase in the hydraulic conductivity of a proppant pack above the limits of conventional technology would result in significant improvements in stimulation economics.

There have been prior attempts at heterogeneous proppant placement. Some prior inventions aim to increase the hydraulic conductivity of a fracture through the heterogeneous placement of proppants in a layer of a formation. Many of these inventions involve pumping different types of slurries or fluids in discrete intervals, known in the industry as "slugs" or "stages". This is claimed to provide higher conductivity fractures than those obtained from conventional treatments, and to increase fracture conductivity by replacing the homogeneous proppant pack with a heterogeneous proppant pack. Proppant structures, sometimes referred to as pillars, clusters, or posts, are placed at intervals throughout the created fracture. These pillars have sufficient strength to hold the fracture partially open under closure stress. The space between pillars forms a network of interconnected open channels, available for flow. This results in a significant increase of the effective hydraulic conductivity of the overall fracture.

Patent application publications US20060113078A1 and US20060113080A1 describes methods of propping at least one fracture in a subterranean formation, by attempting to introduce a plurality of proppant aggregates into at least one fracture, forming a plurality of proppant aggregates, each of which includes a binding fluid and a filler material. In U.S. Pat. Nos. 3,850,247, 3,592,266, 5,411,091, 6,776,235 and patent application publication US20050274523, high conductivity channels are created by pumping alternating intervals of fracturing slurries which are different in at least one of their parameters. For example, in U.S. Pat. No. 3,592,266 it is proposed to create heterogeneity in a proppant pack by pumping alternating volumes of fluids that are significantly different in their viscosities. In U.S. Pat. No. 6,776,235 the fluids differ in their proppant carrying capacity and/or in the concentration of proppant. Each of the above mentioned references are incorporated herein, in their entirety, by reference thereto.

However, in these methods of heterogeneous proppant placement there may be limited control over the location of the pillars. In addition, there is a tendency for the pillars to be very long and to extend the entire height of the fracture (assuming a vertical fracture) and so the channels between the pillars do not lead to the wellbore, and so cannot provide superior pathways from the formation all the way to the wellbore.

A method of heterogeneous proppant placement in which there is better control over the location of the pillars would be of benefit. In addition, placement such that the pillars do not extend the entire height of the fracture (assuming a vertical fracture) but are themselves interrupted by channels so that the channels between the pillars form pathways that do lead to the wellbore, would be very beneficial. It is one goal to provide such heterogeneous proppant placement.

SUMMARY OF THE INVENTION

One embodiment is a method for heterogeneous proppant placement in a fracture in a fracturing layer penetrated by a wellbore. The method includes a slugging step involving injecting alternating slugs of thickened proppant-free fluid and proppant-carrying thickened fluid into the fracturing layer above fracturing pressure through a number of clusters of perforations in the fracturing layer. The slugs of proppant-carrying thickened fluid form pillars of proppant upon fracture closure.

Another embodiment is a method for heterogeneous proppant placement in a fracture in a fracturing layer including a slugging step involving injecting alternating slugs of thickened proppant-free fluid and proppant-carrying thickened fluid into the fracturing layer above fracturing pressure through a number of clusters of perforations in a wellbore in the fracturing layer, and causing the sequences of slugs of thickened proppant-free fluid and proppant-carrying thickened fluid injected through neighboring clusters to move through the fracture at different rates. The slugs of proppant-carrying thickened fluid again form pillars of proppant upon fracture closure.

Yet another embodiment is a method for heterogeneous proppant placement in a fracture in a fracturing layer including a slugging step involving injecting alternating slugs of thickened proppant-free fluid and proppant-carrying thickened fluid into the fracturing layer above fracturing pressure through a number of clusters of perforations in a wellbore in the fracturing layer, and causing the sequences of slugs of thickened proppant-free fluid and proppant-carrying thickened fluid injected through at least one pair of clusters to be separated by a region of injected proppant-free fluid. Again, the slugs of proppant-carrying thickened fluid form pillars of proppant upon fracture closure.

There are many optional variations of these methods. Some or all of the slugs in the slugging step may include a reinforcing material, for example organic, inorganic, or both organic and inorganic fibers, optionally with an adhesive coating alone or with an adhesive coating coated by a layer of non-adhesive substance dissolvable in the thickened fluid during its passage through the fracture; the reinforcing material may be, for example, metallic particles of spherical or elongated shape; and plates, ribbons, and discs of organic or inorganic substances, ceramics, metals or metal alloys. The reinforcing material may have a ratio between length and another dimension of greater than 5 to 1. The reinforcing material may be included only in the proppant-carrying thickened fluid slugs; some or all of the slugs in the slugging step may also include a proppant transport material. An example proppant transport material including elongated particles having the ratio between their length and another dimension greater than 5 to 1. The proppant transport material may be, for example, fibers made from synthetic or naturally occurring organic materials, or glass, ceramic, carbon, or metal. The proppant transport material may be included only in the proppant-carrying thickened fluid slugs, may include or be entirely made of a material that becomes adhesive at formation temperatures, or may further be coated by a non-adhesive material that dissolves in the thickened fluid as it passes through the fracture.

As examples, the reinforcing material may be, for example, elongated particles at least 2 mm long and having a diameter of from 3 to 200 microns, for example from 3 to 200 microns. The weight concentration of the reinforcing material or the proppant transport material in any slug may be from 0.1 to 10%; the volume of the proppant-carrying thickened fluid may be less than the volume of the thickened proppant-free fluid. The proppant may be a mixture of proppant selected to minimize the resulting porosity of the proppant slugs in the fracture. The proppant particles may have a resinous or adhesive coating alone, or a resinous or adhesive coating coated by a layer of non-adhesive substance dissolvable in the fracturing fluid as it passes through the fracture.

In other variations, the methods may have a step following the slugging step involving continuous introduction of proppant-carrying thickened fluid into the fracturing fluid, the proppant having an essentially uniform particle size. The thickened fluid in the step following the slugging step may include a reinforcing material, a proppant transport material, or both. The fluids may be thickened with a polymer or with a viscoelastic surfactant. The number of holes in each cluster may not necessarily be the same. The diameter of holes in all clusters may not necessarily be the same. The lengths of the perforation channels in all clusters may not necessarily be the same. At least two different methods of perforating clusters may be used. Some of the clusters may be produced using an underbalanced perforation technique or an overbalanced perforation technique. The orientations of the perforations in all the clusters relative to the preferred fracture plane may not necessarily be the same.

In another variation, at least two clusters (or every pair of clusters) of perforations that produce a sequence of slugs of thickened proppant-free fluid and proppant-carrying thickened fluid may be separated by a cluster of perforations having sufficiently small perforations that the proppant bridges and proppant-free fluid or substantially proppant-free fluid enters the formation through that cluster. Optionally, the number of perforation clusters is between 2 and 300, for example between 2 and 100; the perforation cluster length is between 0.15 m and 3.0 m; the perforation cluster separation is from 0.30 m to 30 m; the perforation shot density is from 1 to 30 shots per 0.3 and the proppant slugs have a volume between 80 and 16,000 liters.

Optionally the fluid injection design is determined from a mathematical model; and/or the fluid injection design includes a correction for slug dispersion; and/or the perforation cluster design is determined from a mathematical model.

Optionally at least one of the parameters slug volume, slug composition, proppant size, proppant concentration, number of holes per cluster, perforation cluster length, perforation cluster separation, perforation cluster orientation, and perforation cluster shot density, lengths of perforation channels, methods of perforation, the presence or concentration of reinforcing material, and the presence or concentration of proppant transport material is constant along the wellbore in the fracturing layer, or increases or decreases along the wellbore in the fracturing layer, or alternates along the wellbore in the fracturing layer.

Preferably pillars of proppant are formed and placed such that the pillars do not extend an entire dimension of the fracture parallel to the wellbore but are themselves interrupted by channels so that the channels between the pillars form pathways that lead to the wellbore.

DETAILED DESCRIPTION OF THE SOME ILLUSTRATIVE EMBODIMENTS

Figure 1A:
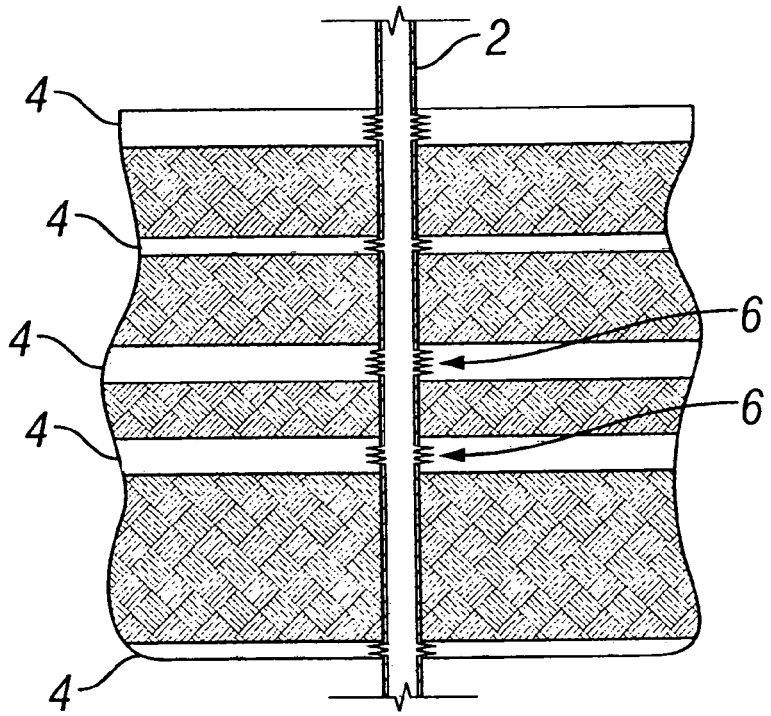
FIG. 1A schematically shows "clustered perforations" as currently used when describing completions in multilayer reservoirs (that conventionally are fractured separately)

Some embodiments illustrating the invention will be described in terms of vertical fractures in vertical wells, but are equally applicable to fractures and wells of any orientation, as examples horizontal fractures in vertical or deviated wells, or vertical fractures in horizontal or deviated wells. The embodiments will be described for one fracture, but it is to be understood that more than one fracture may be formed at one time. Embodiments will be described for hydrocarbon production wells, but it is to be understood that the Invention may be used for wells for production of other fluids, such as water or carbon dioxide, or, for example, for injection or storage wells. The embodiments will be described for conventional hydraulic fracturing, but it is to be understood that embodiments of the invention also may include water fracturing and frac packing. It should also be understood that throughout this specification, when a concentration or amount range is described as being useful, or suitable, or the like, it is intended that any and every concentration or amount within the range, including the end points, is to be considered as having been stated. Furthermore, each numerical value should be read once as modified by the term "about" (unless already expressly so modified) and then read again as not to be so modified unless otherwise stated in context. For example, "a range of from 1 to 10" is to be read as indicating each and every possible number along the continuum between about 1 and about 10. In other words, when a certain range is expressed, even if only a few specific data points are explicitly identified or referred to within the range, or even when no data points are referred to within the range, it is to be understood that the inventors appreciate and understand that any and all data points within the range are to be considered to have been specified, and that the inventors have possession of the entire range and all points within the range.

Note, that throughout this discussion the term "fracturing layer" is used to designate a layer, or layers, of rock that are intended to be fractured in a single fracturing treatment. It is important to understand that a "fracturing layer" may include one or more than one of rock layers or strata as typically defined by differences in permeability, rock type, porosity, grain size, Young's modulus, fluid content, or any of many other parameters. That is, a "fracturing layer" is the rock layer or layers in contact with all the perforations through which fluid is forced into the rock in a given treatment. The operator may choose to fracture, at one time, a "fracturing layer" that includes water zones and hydrocarbon zones, and/or high permeability and low permeability zones (or even impermeable zones such as shale zones) etc. Thus a "fracturing layer" may contain multiple regions that are conventionally called individual layers, strata, zones, streaks, pay zones, etc., and we use such terms in their conventional manner to describe parts of a fracturing layer. Typically the fracturing layer contains a hydrocarbon reservoir, but the methods may also be used for fracturing water wells, storage wells, injection wells, etc. Note also that some embodiments of the invention are described in terms of conventional circular perforations (for example, as created with shaped charges), normally having perforation tunnels. However, the invention is may also be practiced with other types of "perforations", for example openings or slots cut into the tubing by jetting.

One of the most important processes neglected previously in heterogeneous proppant placement in fracturing of fracturing layers is the completion design, which may significantly affect the flow from the wellbore into the created fracture. A completion design (the number, size, and orientation of perforations and the perforation distribution over the pay zone) is disclosed that creates a more suitable flow through the perforations to work as a "slug-splitter" for proppant slugs created at the surface, for example in a blender. The disclosed completion design results in splitting of a proppant slug pumped down the wellbore into a number of separated smaller slugs in a fracture. This completion design and the corresponding number of proppant slugs are optimized to achieve superior performance of the created hydraulic fracture after the treatment. The result is maximization of the amount of open (void) space in the fracture. This, in turn, ensures maximum hydraulic conductivity of the fracture and enhances hydrocarbon production from a reservoir layer. There are additional advantages of creating interconnected (and connected to the wellbore) void channels throughout hydraulic fractures. In particular, (a) longer (and/or higher) fractures can be engineered with the same mass of propping agent, and (b) more effective fracture clean-up can be achieved, that is viscosified fracturing fluid, for example viscosified with a polymer, may be cleaned up from a greater volume of the fracture, or more rapidly, or both.

The perforation design is particularly effective when used in combination with proppant slug blends engineered to minimize slug dispersion during their transport through the hydraulic fracture (as disclosed previously, by inventors of the present invention, in PCT/RU 2006/000026, incorporated herein by reference thereto). Of particular importance are all the general concepts disclosed in PCT/RU 2006/000026 of pumping proppant slugs as well as of pumping proppant slugs blended with proppant consolidation agents and/or proppant transport agents to achieve and maintain slug integrity during slug transport within hydraulic fractures.

In brief, the method disclosed in PCT/RU 2006/000026 includes the following stages:

The first stage of a treatment is a pad (normally crosslinked polymer but may be uncrosslinked polymer or viscoelastic surfactant-based fluid but no propping agents) which initiates fracture formation and furthers propagation.

The second stage consists of a number of sub-stages. During each sub-stage a proppant slug of a given (calculated) proppant concentration is pumped (called a slug sub-stage) followed by a carrier fluid interval (called a no-prop or carrier substage). Each sub-stage may also contain so called consolidation agents, such as fibers. The volumes of both slug and carrier sub-stages significantly affects the hydraulic conductivity of the created HPP (heterogeneous proppant placement) fracture. Slug and no-prop substages are repeated the necessary number of times. The duration of each substage, the proppant concentration, and the nature of the fluid in each subsequent slug may vary.

At the end of the treatment a heterogeneous proppant structure has been formed in the fracture. Following fracture closure, proppant pillars squeeze and form stable proppant formations (pillars) between the fracture walls and prevent the fracture from complete closure.

The method described in PCT/RU 2006/000026, is a hydraulic fracturing method for a subterranean formation, having as a first stage, referred to as the "pad stage", that involves injecting a fracturing fluid into a borehole at a sufficiently high flow rate that it creates a hydraulic fracture in the formation. The pad stage is pumped so that the fracture will be of sufficient dimensions to accommodate the subsequent slurry pumped in the proppant stages. The volume and viscosity of the pad can be designed by those knowledgeable in the art of fracture design (for example, see "Reservoir Stimulation" 3rd Ed. M. J. Economides, K. G. Nolte, Editors, John Wiley and Sons, New York, 2000).

Water-based fracturing fluids are common, with natural or synthetic water-soluble polymers added to increase fluid viscosity and are used throughout the pad and subsequent propped stages. These polymers include, but are not limited to, guar gums: (high-molecular-weight polysaccharides composed of mannose and galactose sugars) or guar derivatives, such as hydroxypropyl guar, carboxymethyl guar, and carboxymethylhydroxypropyl guar. Cross-linking agents based on boron, titanium, zirconium or aluminum complexes are typically used to increase the polymer's effective molecular weight, making it better suited for use in high-temperature wells.

Cellulose derivatives, such as hydroxyethylcellulose or hydroxypropylcellulose and carboxymethylhydroxyethylcellulose, may be used, with or without cross-linkers. Two biopolymers—xanthan and scleroglucan—have excellent proppant-suspension ability, but are more expensive than guar derivatives and so are used less frequently. Polyacrylamide and polyacrylate polymers and copolymers are used typically for high-temperature applications or as friction reducers at low concentrations for all temperatures ranges.

Polymer-free, water-based fracturing fluids can be obtained using viscoelastic surfactants. Usually, these fluids are prepared by mixing into the water appropriate amounts of suitable surfactants, such as anionic, cationic, nonionic and zwitterionic surfactants. The viscosity of viscoelastic surfactant fluids are attributed to the three-dimensional structures formed by the fluid's components. When the surfactant concentration in a viscoelastic fluid exceeds a critical concentration, and in many cases in the presence of an electrolyte co-surfactant, or other suitable additive, surfactant molecules aggregate into species, such as worm-like or rod-like micelles, which interact to form a network exhibiting viscous and elastic behavior.

The method's second stage, referred to as the "propped stage", involves introduction into a fracturing fluid of a proppant in the form of solid particles or granules to form a suspension. The propped stage is divided into two periodically repeated sub-stages, the "carrier sub-stage" involving injection of the fracturing fluid without proppant; and the "propping sub-stage" involving addition of proppant into the fracturing fluid. As a result of the periodic (but not continual) slugging of slurry containing granular propping materials, the proppant does not completely fill the fracture. Rather, spaced proppant clusters form as posts, or pillars, with channels between them through which formation fluids may pass. The volumes of propping and carrier sub-stages as pumped may be different. That is, the volume of the carrier sub-stages may be larger or smaller than the volume of the propping sub-stages. Furthermore the volumes of these sub-stages may change over time. For example, a propping sub-stages pumped early in the treatment may be of a smaller volume then a propping sub-stage pumped latter in the treatment. The relative volume of the sub-stages is selected by the engineer based on how much of the surface area of the fracture he desires to be supported by the clusters of proppant, and how much of the fracture area he desires to be open channels through which formation fluids are free to flow.

In all prior HPP inventions, heterogeneity created in the surface equipment is believed to result in the proppant pack heterogeneity within the hydraulic fracture required to achieve improved fracture performance. Prior inventions ignore physical processes which result in a homogenization of that surface-created heterogeneity during slug transport from the surface down to the hydraulic fracture. An ignorance of these processes may compromise significantly the final hydraulic fracture performance and as such makes the practical execution of prior art questionable. Consequently, the method of PCT/RU 2006/000026 has many improvements over the prior art, all of which may be used to advantage in some embodiments of the Invention, for example, reinforcing (and/or consolidating) materials and/or proppant transport materials.

Reinforcing and/or consolidating materials are introduced into the fracture fluid during the propped stage to increase the strength of the proppant clusters formed and to prevent their collapse during fracture closure. Typically the reinforcement material is added to the propping sub-stage, but this may not necessarily always be the case. The concentrations of both proppant and the reinforcing materials may vary in time throughout the propping stage, and from propping sub-stage to propping sub-stage, and may be continuous or intermittent. As examples, the concentration of reinforcing material and/or proppant may be different in two subsequent propping sub-stages. It may also be suitable or practical in some applications of the method to introduce the reinforcing material in a continuous fashion throughout the propped stage, both during the carrier and propping sub-stages. In other words, introduction of the reinforcing material may not be limited only to the propping sub-stage. In particular, different implementations may be preferable in which the concentration of the reinforcing material does not vary during the entire propped stage; monotonically increases during the propped stage; or monotonically decreases during the propped stage.

Curable, or partially curable, resin-coated proppant may be used as reinforcing and consolidating material to form proppant clusters. The selection of the appropriate resin-coated proppant for a particular bottom hole static temperature (BHST) and for a particular fracturing fluid are well known to experienced workers. In addition, organic and/or inorganic fibers may be used to reinforce the proppant cluster. These materials may be used in combination with resin-coated proppants or separately. These fibers may be modified to have an adhesive coating alone, or an adhesive coating coated by a layer of non-adhesive substance dissolvable in the fracturing fluid as it passes through the fracture. Fibers made of adhesive material may be used as reinforcing material, coated by a non-adhesive substance that dissolves in the fracturing fluid as it passes through the fracture at the subterranean temperatures. Metallic particles are another preference for reinforcing material and may be produced using aluminum, steel containing special additives that reduce corrosion, and other metals and alloys. The metallic particles may be shaped to resemble a sphere and measure 0.1-4 mm. Preferably, fibers such as metallic particles used are of an elongated shape with an aspect ratio (length to width or diameter) of greater than 5:1, for example a length longer than 2 mm and a diameter of 10 to 200 microns. Additionally, plates of organic or inorganic substances, ceramics, metals or metal-based alloys may be used as reinforcing material. These plates may be disk or rectangle-shaped and of a length and width such that for all materials the ratio between any two of the three dimensions is greater than 5 to 1.

Both the carrier and propping sub-stages may include introduction of an agent or agents into the fracturing fluid to increase its proppant transport capability, in other words, an agent that reduces the settling rate of proppant in the fracture fluid. This agent may be a material with elongated particles whose length much exceeds their diameter. This material affects the rheological properties and suppresses convection in the fluid, which results in a decrease of the proppant settling rate in the fracture fluid. Materials that may be used include fibers that are, for example, organic, inorganic, glass, ceramic, nylon, carbon and metallic. The proppant transport agents may be capable of decomposing in the water-based fracturing fluid or in the downhole fluid; examples include fibers made based on, for example, polylactic acid, polyglycolic acid, polyvinyl alcohol, and others. The fibers may be coated by or made of a material that becomes adhesive at subterranean formation temperatures. They may be made of adhesive material coated by a non-adhesive substance that dissolves in the fracturing fluid as it passes through the fracture. The fibers used are generally longer than 2 mm with a diameter of 10-200 microns, in accordance with the main condition that the ratio between any two of the three dimensions be greater than 5 to 1 (that is, they have an aspect ratio (length to width or diameter) of greater than 5:1). Again, the term "fiber" as so-defined here may include materials commonly described as ribbons, discs, plates, etc. The weight concentration of the fibrous material in the fracturing fluid is, for example, from 0.1 to 10%.

The concentrations of proppant transport material may vary in time throughout the propping stage, and from propping sub-stage to propping sub-stage, and may be continuous or intermittent. As examples, the concentration of proppant transport material and/or proppant may be different in two subsequent propping sub-stages. It may also be suitable (for example, easier) in some applications of the method to introduce the proppant transport material in a continuous fashion throughout the propped stage, both during the carrier and propping sub-stages. In other words, introduction of the proppant transport material is not limited only to the propping sub-stage. In particular, different implementations may be preferable in which the concentration of the proppant transport material does not vary during the entire propped stage; monotonically increases during the propped stage; or monotonically decreases during the propped stage.

Proppant choice is significant to the method of PCT/RU 2006/000026 (and to the present Invention); proppant should be chosen with consideration of increasing the strength of proppant clusters (pillars) after fracture closure. A proppant cluster should maintain a reasonable residual thickness at the full fracture closure stress. This ensures an increase in fluid flow through open channels formed between the proppant clusters. In this situation, the proppant pack permeability, as such, is not decisive for increasing well productivity. Thus, a proppant cluster may be created successfully using sand whose particles are too weak for use in standard hydraulic fracturing in the formation of interest. A proppant cluster may also be made from sand that has a very wide particle size distribution that would not be suitable for conventional fracturing. This is an important advantage, because sand costs substantially less than ceramic proppant. Additionally, destruction of sand particles during application of the fracture closure load might improve the strength of clusters consisting of sand granules. This can occur because the cracking/destruction of sand proppant particles decreases the cluster porosity and increases the proppant compactness. Sand pumped into the fracture to create proppant clusters does not need good granulometric properties, that is, the usually desirable narrow diameter distribution of particles. For example, to implement the method, it may be suitable to use 50,000 kg of sand, of which 10,000 to 15,000 kg have a diameter of particles from 0.002 to 0.1 mm, 15,000 to 30,000 kg have a diameter of particles from 0.2 to 0.6 mm, and 10,000 to 15,000 kg have a diameter of particles from 0.005 to 0.05 mm. It should be noted that about 100,000 kg of a proppant more expensive than sand would be necessary to obtain a similar value of hydraulic conductivity in the created fracture using the prior (conventional) methods of hydraulic fracturing.

It may be preferable in some embodiments to use sand with an adhesive coating that is cured at the formation temperature, causing the sand particles to conglutinate. Bonding particles within the clusters reduces the proppant cluster erosion rate as formation fluids flow past the cluster, and minimizes proppant cluster destruction by erosion.

Of course, all conventional and non-conventional proppants may be used in PCT/RU 2006/000026 (and in the present Invention). This includes, as non-limiting examples, such natural and synthetic materials as metallic ribbons, needles or discs, abrasive granules, organic and inorganic fibers, ceramics, crushed seeds, shells, or hulls, gravel, glass beads, sintered bauxites and other materials.

In some versions of the method, the propping stage may be followed by a third stage, referred to as the "tail-in stage", involving continuous introduction of an amount of proppant. If employed, the tail-in stage of the fracturing treatment resembles a conventional fracturing treatment, in which a continuous bed of well-sorted conventional proppant is placed in the fracture relatively near to the wellbore. The tail-in stage may involve introduction of both an agent that increases the fluid's proppant transport capability and/or an agent that acts as a reinforcing material. The tail-in stage is distinguished from the second stage by the continuous placement of a well-sorted proppant, that is, a proppant with an essentially uniform size of particles. The proppant strength in the tail-in stage is sufficient to prevent proppant crushing (crumbling) when it is subjected to the stresses that occur upon fracture closure. The role of the proppant at this stage is to prevent fracture closure and, therefore, to provide good fracture conductivity in proximity to the wellbore. The proppants used in this third stage should have properties similar to conventional proppants.

The improved completion design (perforation strategy) is used most advantageously with the slug hydraulic fracturing method of PCT/RU 2006/00026, for example, with the use of reinforcing (and/or consolidating) materials and/or proppant transport materials, and will be described substantially in terms of that method, but the improved completion design of the present Invention may be used with other hydraulic fracturing methods as well.

As was mentioned, all prior patents assume that heterogeneity introduced at the early stage of hydraulic fracturing treatment, that is at the time when fluids are mixed and pumped into the wellbore, will be preserved throughout the complete hydraulic fracturing treatment. In particular, the slug method disclosed in PCT/RU 2006/000026 teaches a general concept and teaches specific slug blends required to achieve slug consolidation during transport within a hydraulic fracture. But it does not teach the following methods of maximizing the void space in a fracture in order to achieve superior well performance.

Some embodiments comprise a completion design (the number, size, and orientation of perforations and the perforation distribution over the pay zone) which works as a "slug-splitter" for a proppant slug blended in surface equipment, even when injection is into a single, homogeneous formation layer (that is, even when the fracturing layer is a single, homogeneous formation layer). The completion designs result in the splitting of the proppant slugs pumped down the wellbore into a predetermined number of separated smaller slugs in a fracture. The number of proppant slugs and the corresponding completion design are optimized to achieve superior performance of the created hydraulic fracture.

Some embodiments include:

1. A method of pumping proppant slugs in order to create a hydraulic fracture with heterogeneous proppant pack (such as, but not limited to, the method of PCT/RU 2006/000026). Interconnected voids within the proppant pack form a network of channels throughout the fracture from its tip to the wellbore. The network of channels results in a significant increase of the effective hydraulic conductivity of the created hydraulic fracture. Proppant slug blends are designed to minimize slug dispersion during transport within the hydraulic fracture. Effective consolidation agents and/or proppant transport agents are preferably added to proppant slugs to ensure stability against dispersion.

2. A completion design (perforation size and distribution) developed to work as a "slug-splitter", to transform each slug in a wellbore into several slugs within the fracture. This is important for practicing a slug method because fracture performance depends on the number of slugs within the fracture created, and on the special distribution of the slugs. A number of slugs is determined, preferably calculated from a model, and then a number of perforation clusters is calculated to result in superior fracture performance.

Figure 1B:
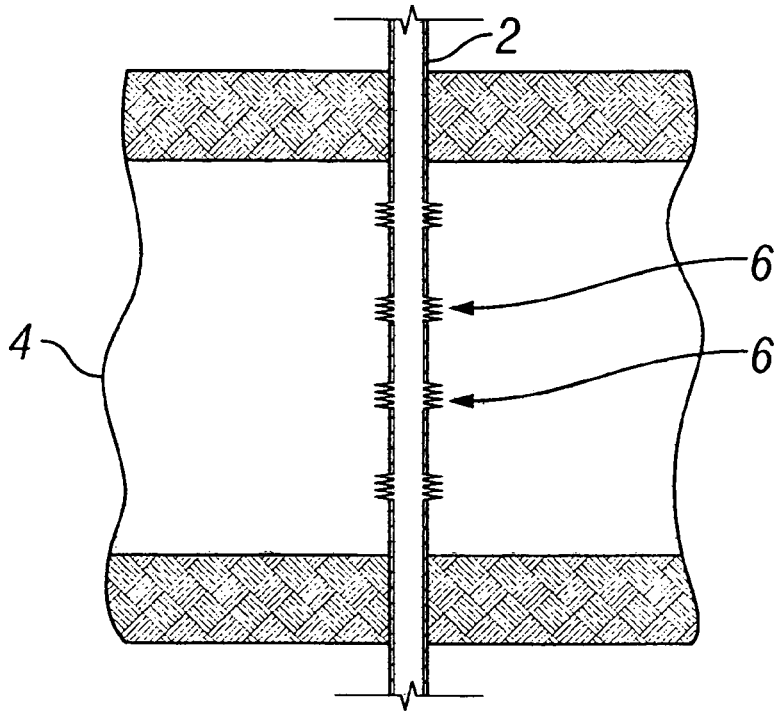
FIG. 1B schematically shows grouping (clustering) of perforations over the height of single pay zone (conventionally fractured in a single treatment).

The completion design terms "clustered completion," "clustered perforations," "perforation cluster," and "clustered perforations" and the like, for the purposes of this disclosure, designate a number of groups of perforations over the length of a perforated interval. There is a principal difference in how these terms are currently used in the industry and the way they are used in this disclosure. This difference is illustrated schematically in FIGS. 1A and 1B. Conventionally, the term "clustered perforation" is used to describe completion designs in a situation of multiple pay zones (layers) in a fracturing layer (such as that shown in FIG. 1A). FIGS. 1A and 1B schematically show "clustered perforations" and grouping (clustering) of perforations over the height of a single pay zone, respectively. For example, disclosed in the present document is a completion design in which perforations are grouped (clustered) within the length of a fracturing layer that is, in many instances, a single pay zone (such as is shown in FIG. 1B in which the fracturing layer is a single rock layer). The wellbore [2] penetrates pay zones [4] containing perforation clusters [6].

It should be noted that although some embodiments are described for the case in which the fracturing layer is a single rock layer, it is not limited to use in single layers. The fracturing layer may be a single pay zone made up of multiple permeable layers. The fracturing layer may also be made up of more than one pay zone separated by one or more impermeable or nearly impermeable rock layers such as shale layers, and each pay zone and each shale layer may in turn be made of multiple rock layers. In one embodiment, each pay zone contains multiple perforation clusters and the processes of the invention occur in more than one pay zone in a single treatment. Optionally, at least one of the pay zones is treated by the method and at least one of the pay zones is treated conventionally, in a single fracturing treatment. The result is more than one fracture, at least one of which contains proppant placed heterogeneously according to the method of the invention. In another embodiment, the fracturing layer is made up of more than one pay zone separated by one or more impermeable or nearly impermeable rock layers such as shale layers, and each pay zone and each shale layer may in turn be made of multiple rock layers, and at least one pay zone contains multiple perforation clusters and the processes of the invention occur in at least one pay zone in a single treatment, but the job is designed so that a single fracture is formed in all the pay zones and in any intervening impermeable zones. Of course, any embodiment may be implemented more than once in one well.

A single perforation cluster is the number of perforation holes (or slots) shot (or cut) over a finite interval in a fracturing layer (which will be described here as being in a single pay zone), separated from another cluster or other clusters within the same pay zone spaced away from that cluster by another finite interval. A perforation cluster is characterized by its length, the total number of holes (slots), the size of the holes (slots) and the phasing of the holes (slots). A number of perforation clusters placed over a single pay-zone interval constitute a "clustered completion" design in the present Invention. The spacing between neighboring clusters as well as all parameters which describe clusters (length, shot density, etc) can vary over the length of the pay-zone. The number and nature of perforation clusters may vary significantly for different formations and different pay zones within a given formation. For the majority of wells suitable for practicing this Invention the number of perforation clusters per given pay zone will, for example, be between 1 and 100. There might be some wells which require placing a larger number of clusters, for example up to 300. Perforation cluster length may vary from well to well but in general will preferably be within a range of 0.15 m to 3.0 m (0.5 ft to 10 ft). Cluster separations may vary significantly from, for example, 0.30 m to 30 m (1 ft to 98.4 ft) and even reach, for example, 91.4 m (300 ft) for some reservoirs. Shot density within a cluster depends upon the reservoir parameters and typically falls within a range of, for example, from 1 to 30 shots per 0.3 m (foot).

Completions designs having perforation holes evenly distributed over an entire perforated interval will hereinafter be referred to as "conventional" perforation designs. Proppant slugs pumped through perforations into a fracture will hereinafter be referred to as proppant "pillars". Slug proppant concentrations as measured on the surface may vary significantly from 0.06 kg/L (0.5 lb per gallon (ppa)) of fluid to 2.4 kg/L (20 ppa) a depending upon certain reservoir parameters such as formation permeability, fluid leak-off into the formation, etc. Proppant concentration in a slug may also vary over the course of a single hydraulic fracturing job in much the same way as for conventional treatments. At the beginning of a hydraulic fracturing job, proppant concentration may, for example, be as low as 0.06 kg/L (0.5 ppa) and then be ramped up to, for example, 2.4 kg/L (20 ppa) at the end of the treatment. The majority of jobs will require a narrower span of slug proppant concentrations during the treatment, for example from 0.24 kg/L (2 ppa) to 1.8 kg/L (15 ppa).

Figure 2:
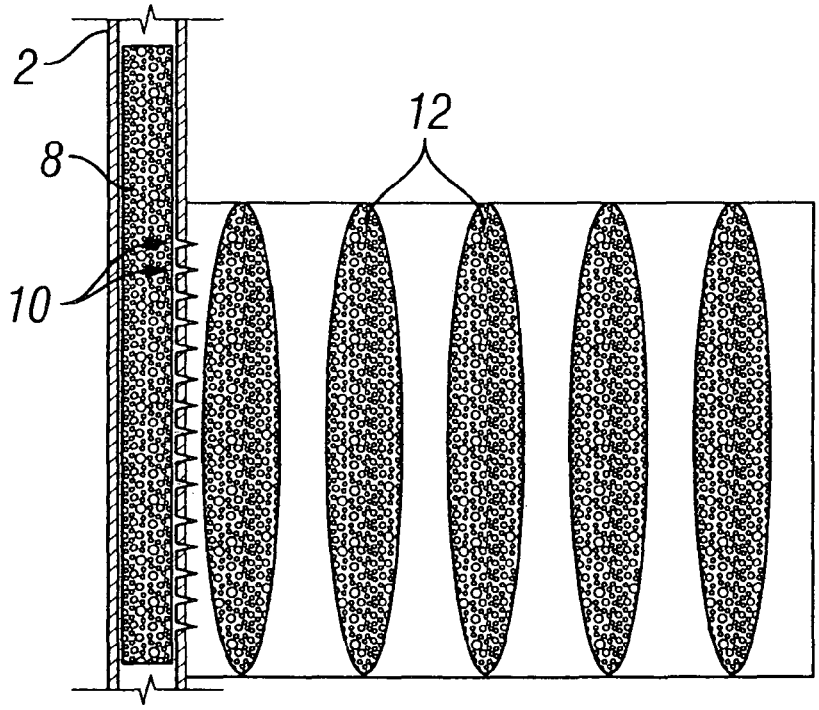
FIG. 2 schematically shows the "stripe-like" pillars that are believed to be formed when proppant slugs are pumped into a wellbore with a conventional perforation design.

FIG. 2 shows a slug of proppant carrying slurry [8] in the wellbore [2] adjacent perforations [10]. (In FIGS. 2, 3, 4, 5 and 7 fractures are shown schematically as having squared off edges, and pillars are shown schematically as being cylindrical or rectangular; in reality, of course, fractures are more like those shown in FIG. 8, and pillars are irregular.) Those skilled in the art of squeezing a viscous fluid through an array of holes would understand that proppant slugs pumped through conventionally designed perforations would be expected to form "stripe-like pillar" structures [12] in a fracture, similar to the ones shown in FIG. 2 (which shows a single cluster of perforations in a single pay zone). Each "stripe pillar" corresponds to one proppant slug. Voids between the pillars occur naturally due to the no-prop intervals between proppant slugs. In a situation like that shown in FIG. 2, all the voids are separated from one another by proppant stripes. These stripes significantly reduce the effective fracture conductivity, because the voids are not interconnected by channels. Such a treatment would have a marginal potential increase in well productivity because there is no route for produced fluid to flow through the fracture to the well entirely through voids; at many locations the produced fluid must pass through proppant beds (the stripes). In order to utilize the heterogeneous proppant pack potential fully, one needs to engineer channels (which are optimally parallel to the direction of fluid flow) to connect the void spaces created by the no-slug intervals.

Figure 3:
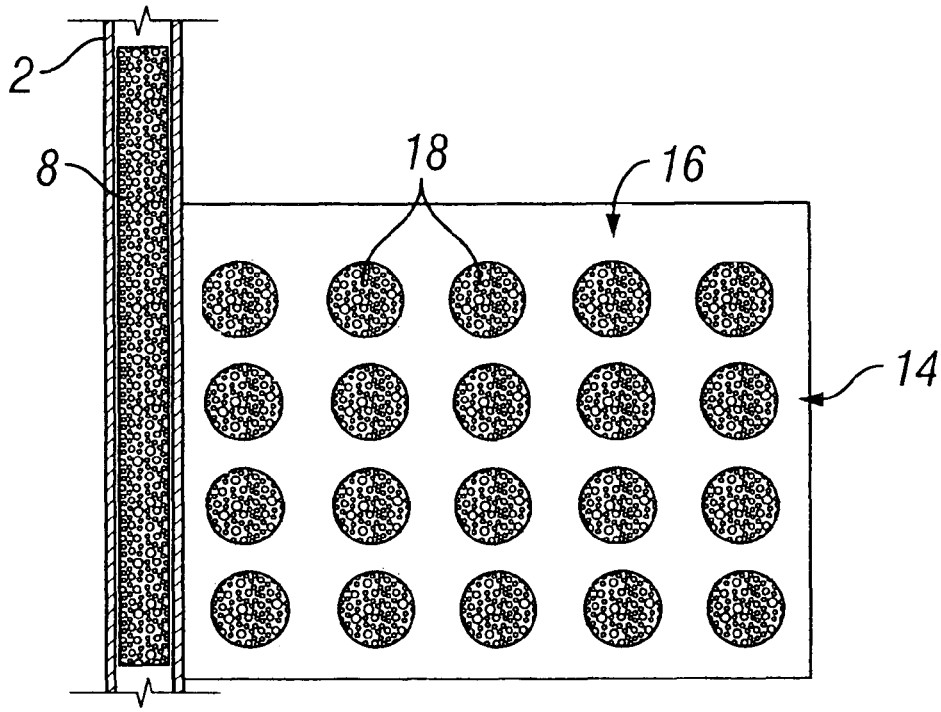
FIG. 3 schematically depicts a simplified model used to calculate the optimum distribution of pillars in a fracture and, in particular, the numbers of pillar rows and columns.

A first step in designing and executing proppant slug treatments according to the current Invention is to consider pillar matrices similar to that shown in FIG. 3. Models that have been developed take into account both formation and pillar mechanical properties and calculate the appropriate number of pillars for a given fracture length and height (also referred to as the number of pillar columns and rows in a matrix structure such as is shown in FIG. 3, that shows four horizontal rows [14], each containing five columns [16] of pillars [18]) as well as characteristic pillar sizes required to maximize the void space in a heterogeneously packed fracture, while maintaining adequate propping after closure. An example of such a model is given by J. M. Tinsley and J. R. Williams, Jr., "A New Method for Providing Increased Fracture Conductivity and Improving Stimulation Results," SPE Paper 4676, 1975.

The perforation strategy and completion design are calculated on the basis of formation properties. If the formation is weak (has a low Young's modulus) and/or the formation has a high closure stress, then there should be many proppant pillars (and/or they should be large and/or they should be close together) and the void space should be low. Otherwise, there may be a point or points in which the fracture walls touch one another on closure, and this is preferably avoided. If the formation is strong and/or the closure pressure is low, then there may be fewer and/or smaller/and/or more widely spaced pillars and the void volume may be greater. From these considerations the pillar spacing size for a job is determined and then from that the perforation cluster size and the spacing between clusters for the completion is determined, and then the pumping schedule (proppant slug size vs. carrier slug size, number of slugs, proppant concentration in slugs, proppant type, and additives such as consolidation agents and proppant transport agents).

Figure 4:
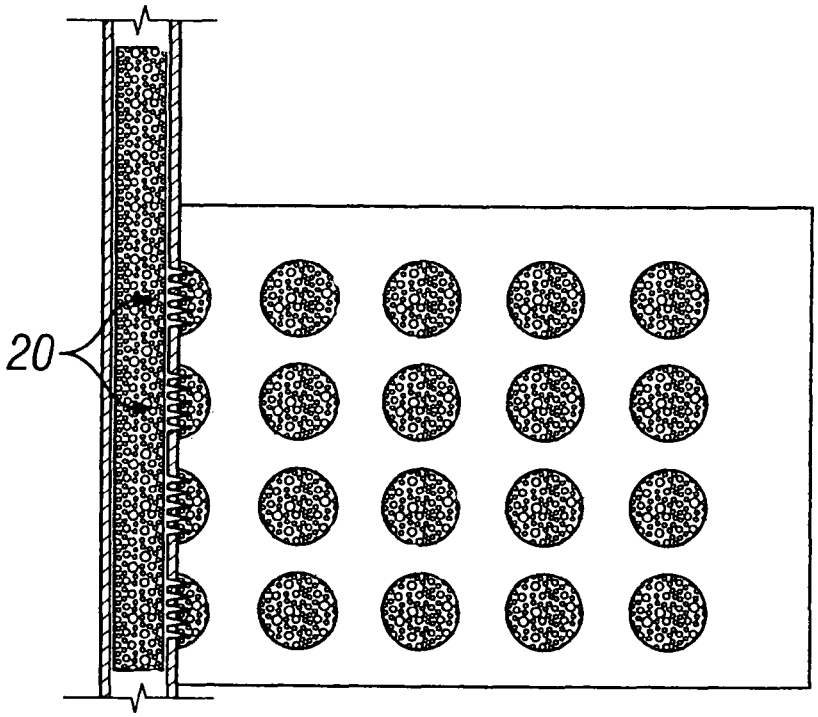
FIG. 4 is a schematic representation of a completion design of four clusters and its use to obtain a pillar matrix composed of four rows and the number of columns (in this case four) corresponding to the number of proppant slugs pumped from the surface.

In some cases, an important concept is that the number of slugs created in surface equipment and pumped downhole should correspond to the number of pillar columns (considering a vertical fracture, as represented in the Figures) to be placed within the hydraulic fracture. The number of pillar rows to be placed within the hydraulic fracture is controlled by the clustered perforation design, that is, the number of pillars in a row is determined by and equal to the number of perforation clusters. For example, if model calculations show that four rows are required to achieve maximum performance of the heterogeneous fracture then the completion will be designed to have four perforation clusters [20], as shown in FIG. 4.

Simulations conducted have shown that the number of perforation clusters required for a given formation typically may vary from 1 to 100, but may be as high as 300 for some the formations. Suitable sizes of pillars depends upon a number of factors, such as the "slug surface volume" (the product of the slurry flow rate and the slug duration), the number of clusters, the leak-off rate into the formation, etc. Calculations have revealed the importance of slug duration on the overall productivity of the heterogeneous fracture produced. Many reservoirs may require the slug duration to span a range of, for example, 2 to 60 sec (this corresponds to a slug surface volume of about 80 to 16,000 liters (0.5 to 100 barrels (bbl)) given a range of flow rates for a typical fracturing job of from 3,200 to 16,000 liters/minute (20 to 100 barrels per minute (bpm)). Other reservoirs will require proppant slug durations (as measured in the surface equipment) to be up to, for example, 5 min (16,000 to 79,500 liters (100 to 500 bbl) of frac fluid given a flow rate of 3,200 to 16,000 liters/minute (20-100 bpm)). And finally, for those treatments in which part of the fracture should be covered with proppant homogeneously, slugs may last for 10-20 minutes and longer. Furthermore, slug duration may also vary throughout the treatment in order to vary characteristic pillar footprints within a single hydraulic fracture. Typical ranges of slug duration will be the same as just detailed above. For example, a pumping schedule may start with 1 min long slugs and finish pumping with 5 sec long proppant slugs with 5 sec no-proppant intervals between them.

A typical fracturing treatment is performed at the surface in accordance, for example, with the slug treatment general concept and the types of slug blends described in PCT/RU 2006/000026. After the design step, during actual preparation of a treatment, proppant slugs mixed in the surface equipment are transported downhole. Not to be bound by theory, but it is believed that when a proppant slug hits a "clustered completion" similar to the one having four clusters as shown in FIG. 4, it is split into four distinct smaller slugs as it is squeezed into the fracture. In the example demonstrated in FIG. 4, all clusters were designed to have similar physical properties such as shot density, the total number of shots per cluster, etc.

The proppant concentration profile may be varied according to a dispersion method. For example, the model may include process control algorithms which may be implemented to vary surface proppant concentration profile to deliver a particular proppant slug concentration profile at perforation intervals. Under a normal pumping process, a slug of proppant injected into a wellbore will undergo dispersion and stretch and loose "sharpness" of the proppant concentration at the leading and tail edges of the proppant slug. For a uniform proppant concentration profile, the surface concentration profile may be solved by inverting a solution to a slug dispersion problem. Dispersion may thus be a mechanism which "corrects" the slug concentration profile from an initial surface value to a particular downhole profile.

With reference to E. L. Cussler, Diffusion: Mass Transfer in Fluid Systems, Cambridge University Press, pp. 89-93 (1984), an example of a system of equations that may be solved is shown below for a Taylor dispersion problem—laminar flow of a Newtonian fluid in a tube, where a solution is dilute, and mass transport is by radial diffusion and axial convection only. Virtually any fluid mechanics problem may be substituted for the above system, including turbulent or laminar flow, Newtonian or non-Newtonian fluids and fluids with or without particles. In practice, a downhole concentration profile will be defined, and equations solved in the inverse manner to determine initial conditions, for example, rates of addition for proppant, to achieve particular downhole slug properties.

The equations may include, for example, $$\bar{c}_1 = \frac{M/\pi R_0^2}{\sqrt{4\pi E_z t}} e^{-(z-v^0 t)^2/4E_z t}$$

where M is total solute in a pulse (the material whose concentration is to be defined at a specific downhole location), Ro is the radius of a tube through which a slug is traveling, z is the distance along the tube, $v^0$ is the fluid's velocity, and t is time. A dispersion coefficient Ez can be shown to be, $$Ez = \frac{(R_0 v^0)^2}{48D}$$

where D is a diffusion coefficient. A system of equations that yield this solution follows. Variable definitions can be found in E. L. Cussler, Diffusion: Mass Transfer in Fluid Systems, Cambridge University Press, pp. 89-93 (1984).

$$\frac{\partial \bar{c}_1}{\partial \tau} = \left(\frac{v^0 R_0}{48D}\right)\frac{\partial^2 \bar{c}_1}{\partial \zeta^2}$$

subject to the conditions, $$\tau = 0, \text{ all } \zeta, \bar{c}_1 = \frac{M}{\pi R_0^2}\delta(\zeta)$$

$$\tau > 0, \zeta = \pm\infty, \bar{c}_1 = 0$$

$$\tau > 0, \zeta = 0, \frac{\delta \bar{c}_1}{\delta \tau} = 0$$

The system of equations above may be applied in general to design any downhole proppant concentration profile, slugged or continuous. The solution for a dispersion of granular material flow in a fluid down a wellbore may be inverted to calculate a corresponding surface concentration of proppant in the fracturing fluid. Process control technology may then take this surface concentration schedule and proportion the proppant accordingly. For example, the surface concentration schedule may be factored into the model, the proppant placement schedule adjusted to the model and proppant delivered according to the proppant placement schedule. Note that the equations shown do not take the optional presence of fibers into account but may be adapted to account for fiber-laden fluid.

In some job designs, there may be an advantage to varying these parameters to obtain "clustered completions" having cluster properties varying from one cluster to another. This may be done to enhance heterogeneity in a fracture and to split slugs more effectively into several smaller slugs (pillars). An approach having identical clusters may be best suited for the situation in which relatively small proppant pillars are needed to achieve maximum performance of a heterogeneous fracture. If larger pillars are required and there is a concern that smaller slugs would heal back into one big "stripe pillar" after they leave the perforations, then several techniques have been identified that may be especially useful for keeping proppant slugs separated and thus creating horizontal channels in a proppant pack.

Three example techniques described below are useful to amplify slippage of proppant pillars relatively to each other (in other words, to prevent adjacent slugs from combining).

Figure 5:
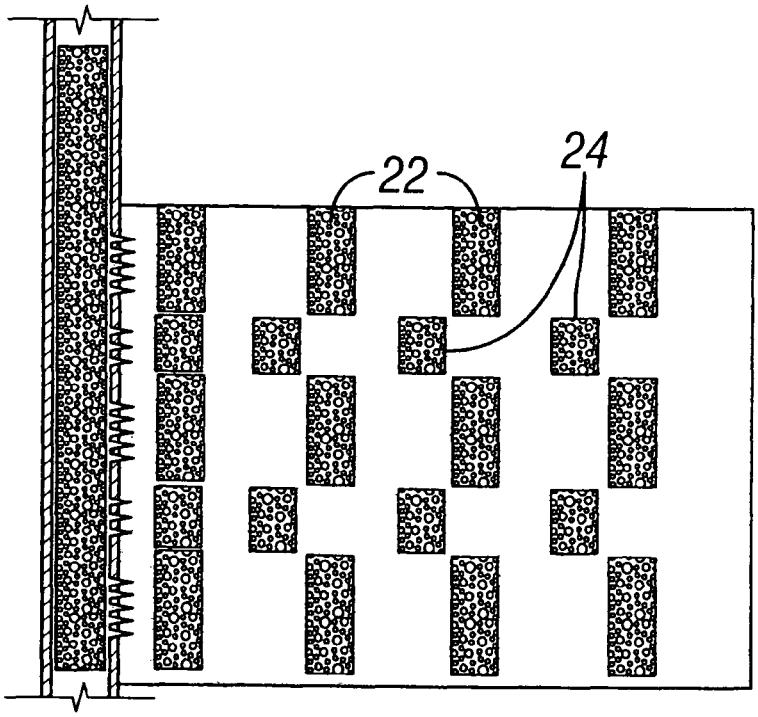
FIG. 5 schematically shows the results of modulation of cluster hydraulic impedance designed to enhance heterogeneity in a proppant pack in a fracture.

The first technique will be referred to as "cluster impedance modulation" and is shown schematically in FIG. 5. The purpose of "cluster impedance modulation" is to modulate (change) the hydraulic impedance. A change in the hydraulic impedance may be achieved, for example, by varying the total number of holes within a cluster, and/or varying the diameters of the holes from cluster to cluster, and/or by varying the lengths of the perforated channels from cluster to cluster. A variation in impedance may also be achieved, for example, by utilizing two different methods for perforating clusters. For example, odd numbered clusters may be perforated by using an underbalanced perforation technique and even numbered clusters by using an overbalanced perforation method. As a result there is a difference in the physical properties of the perforated tunnels within the odd and even numbered clusters, which in turn creates a difference in the hydraulic impedance between any pair of adjacent clusters.

This difference in hydraulic impedances results in a difference of the effective shear rates the proppant slugs experience as they flow through different clusters (assuming constant pressure drops across each of the clusters). Exposure to different shear rates causes proppant slugs to have slightly different viscosities when entering a hydraulic fracture (due to the shear sensitivity of fluids used to carry proppant) and hence to move with slightly different linear velocities upon entry into the fracture. Thus, some of the pillars, for example those indicated as [22], will move faster (and so farther) than other pillars, for example those indicated as [24]. Even though fluid viscosity may heal back, or nearly back, to its original value after some time in a fracture, the initial difference in viscosities results in promotion of heterogeneity in the pack. Although in the particular example of FIG. 5, the cluster impedances are modulated in an alternating manner, in general cluster impedance may change in other ways, for example rise linearly, drop linearly etc. To summarize, in order to enhance heterogeneity and create horizontal channels in a proppant pack using the technique of cluster hydraulic impedance modulation, the operator needs to design a cluster pattern in such a way that the impedances of neighboring clusters are different.

Figure 6:
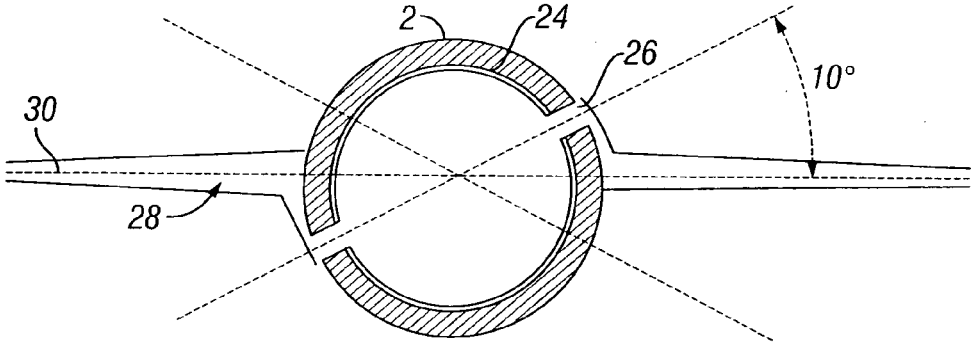
FIG. 6 is a schematic example of variation in perforation orientation between neighboring clusters designed to promote slippage of pillars relative to each other.
Figure 7:
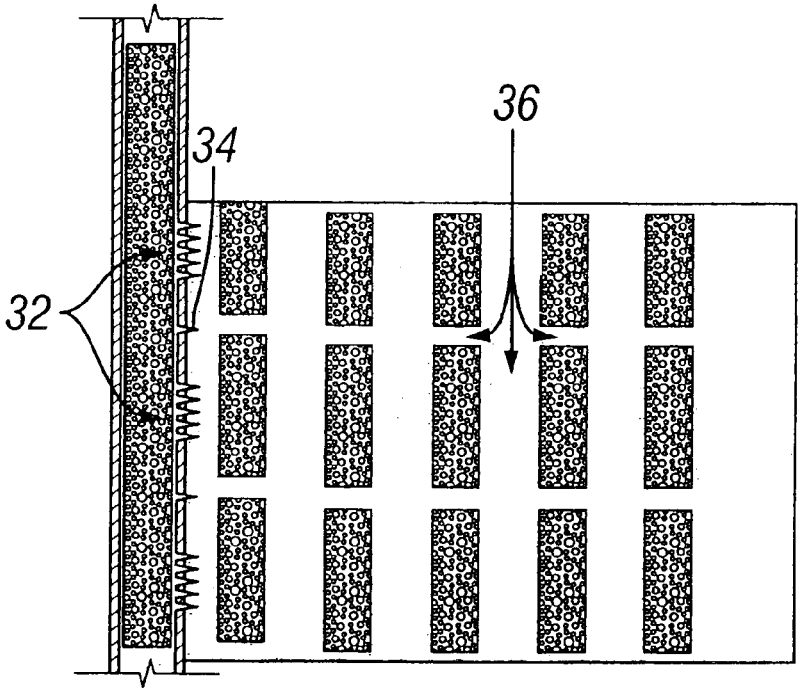
FIG. 7 schematically shows a method of modulation of cluster sizes in which proppant particles bridge while flowing through a cluster designed to have a sufficiently low hole diameter; gel filters through such bridged clusters and supplies a small but constant amount of clean gel to prevent healing together of pairs of pillars from neighboring clusters.
Figure 8A:
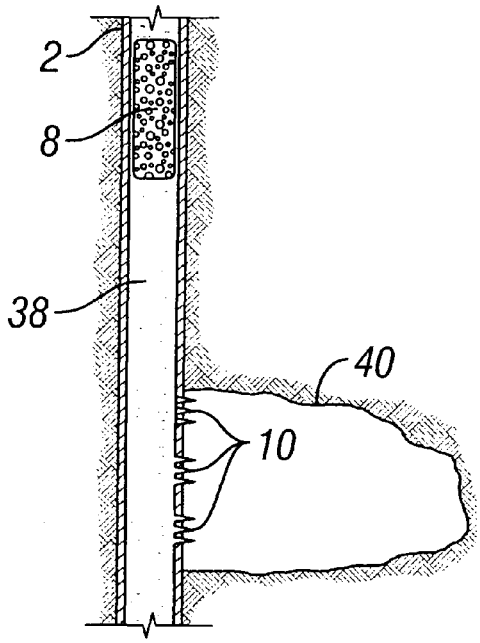
FIG. 8A is a schematic representation of a first stage of a proppant slug placement technique combined with a perforation design of the invention to obtain highly conductive channels within a proppant pack.
Figure 8B:
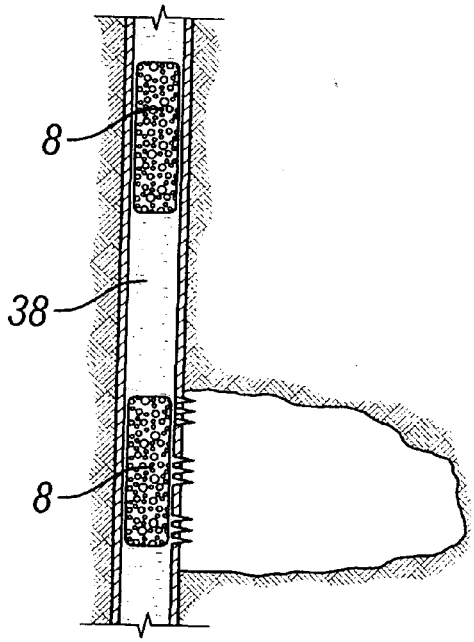
FIG. 8B is a schematic representation of a second stage of a proppant slug placement technique combined with a perforation design of the invention to obtain highly conductive channels within a proppant pack.
Figure 8C:
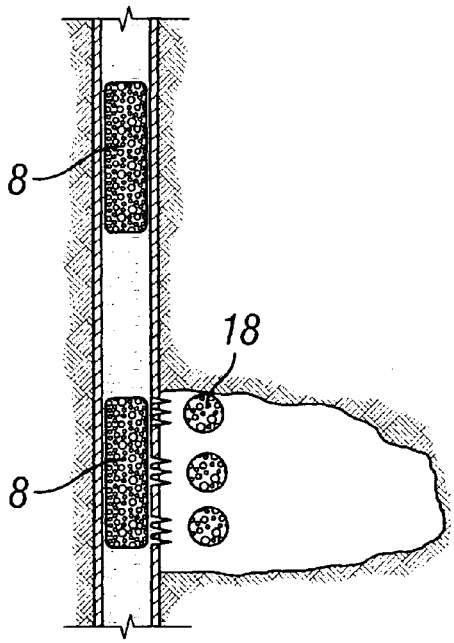
FIG. 8C is a schematic representation of a third stage of a proppant slug placement technique combined with a perforation design of the invention to obtain highly conductive channels within a proppant pack.
Figure 8D:
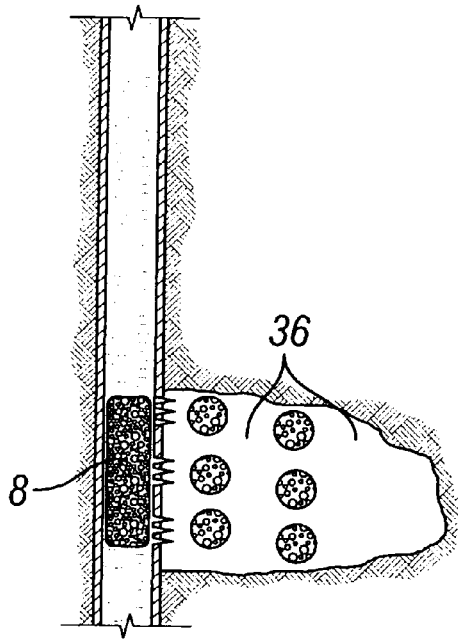
FIG. 8D is a schematic representation of a forth stage of a proppant slug placement technique combined with a perforation design of the invention to obtain highly conductive channels within a proppant pack.

A second approach is based on the orientation of the perforation tunnels (the phasing of the perforations) relative to the preferred fracture plane (PFP); the phasing is varied between neighboring clusters in order to achieve slippage of adjacent pillars. Phasing changes preferably alternate between adjacent perforation clusters, but may change in the same direction for several sets of clusters and then start changing back. This technique is illustrated in FIG. 6, which shows a wellbore [2] lined with casing [24] penetrated by perforations [26] that have created a fracture [28]. The hydraulic fracture is expected to propagate along the main PFP [30] (a plane perpendicular to the direction of the minimum stress in a formation which intersects the wellbore approximately at its center) when the orientation of perforation tunnels lies within 10 degrees relative to the main PFP. In such a situation, the total hydraulic impedance of a perforation tunnel within a cluster is determined by, among other parameters, a contribution to the near wellbore pressure drop from a tortuous part of the hydraulic fracture in the near-wellbore region. Changing the angle of orientation of perforation tunnels in adjacent clusters relative to the main PFP, would introduce a difference between the hydraulic impedances of the adjacent clusters and thus promote slippage, and hinder merging, of adjacent proppant pillars as they move through the fracture. Shown in FIG. 6 is a case of 180° phase perforations, but the use of this angle modulation technique is not limited to the case of 180° deg oriented perforations.

Variation of near-wellbore hydraulic impedance by angle modulation may be used with other perforation phasing including, for example, 60° deg phasing. This angle modulation technique, too, may be used alone or combined with other techniques of varying hydraulic impedance.

A third technique used to ensure pillar separation by promoting hydraulic impedance modulation is the "bridged cluster" approach. A typical cluster design required to accomplish this method is shown schematically in FIG. 7. In this approach each pair of clusters that would be adjacent to one another if this technique were not used [32] is separated by one cluster [34] that has relatively small diameter perforation holes, so that proppant particles bridge within this special cluster and form a plug. The proppant plug formed filters out additional proppant and allows of clean gel (gel not containing proppant), or almost clean gel, typically in a small amount, to flow into the fracture. This clean gel for example at location [36] helps to prevent the two proppant slugs extruded from the two clusters that would otherwise be neighboring, were it not for the intervening clean gel plug, from healing back together. The appropriate perforation size depends upon the proppant size and is well known to those of ordinary skill in the art. The number of clusters required to obtain the calculated number of rows in a fracture is almost doubled.

FIGS. 8A to 8D show the progress of a proppant slug placement technique combined with a completion design of the Invention. Proppant slugs [8] alternating with proppant free slugs [38] are pumped down the wellbore [2] (see FIGS. 8A and 8B) through perforation clusters [10] to form pillars [18] (see FIG. 8 C) separated by clean gel voids [36] in the fracture [40] formed (see FIG. 8D).

There are numerous advantages. The open channels have extremely high hydraulic conductivity. Fluid flow in the fracture is through large channels, eliminating the loss of hydraulic conductivity due to fines migration and pore-throat damage. The existence of large open channels ensures more effective fracture clean-up. There is a separation of the dual roles of the proppant pack, as a means of providing both mechanical support and a hydraulically conductive permeable bed; therefore the propping structures may be optimized for suitable strength, and the dimensions of the open channels can be optimized for hydraulic conductivity.

We claim:

1. A method for heterogeneous proppant placement in a fracture in a fracturing layer penetrated by a wellbore, the method comprising a slugging step comprising injecting alternating slugs of thickened proppant-free fluid and proppant-carrying thickened fluid into the fracturing layer above fracturing pressure through a plurality of clusters of perforations in the fracturing layer, wherein the slugs of proppant-carrying thickened fluid form pillars of proppant upon fracture closure.

2. The method of claim 1 wherein at least one of the parameters slug volume, slug composition, proppant size, proppant concentration, number of holes per cluster, perforation cluster length, perforation cluster separation, perforation cluster orientation, and perforation cluster shot density, lengths of perforation channels, methods of perforation, the presence or concentration of reinforcing material, and the presence or concentration of proppant transport material alternates along the wellbore in the fracturing layer.

3. A method for heterogeneous proppant placement in a fracture in a fracturing layer, the method comprising:

a) a slugging step comprising injecting alternating slugs of thickened proppant-free fluid and proppant-carrying thickened fluid into the fracturing layer above fracturing pressure through a plurality of clusters of perforations in a wellbore in the fracturing layer, and b) causing the sequences of slugs of thickened proppant-free fluid and proppant-carrying thickened fluid injected through neighboring clusters to move through the fracture at different rates, wherein the slugs of proppant-carrying thickened fluid form pillars of proppant upon fracture closure.

4. A method for heterogeneous proppant placement in a fracture in a fracturing layer comprising:

a) a slugging step comprising injecting alternating slugs of thickened proppant-free fluid and proppant-carrying thickened fluid into the fracturing layer above fracturing pressure through a plurality of clusters of perforations in a wellbore in the fracturing layer, and b) causing the sequences of slugs of proppant-carrying thickened fluid injected through at least one pair of clusters to be separated by injected proppant-free fluid, wherein the slugs of proppant-carrying thickened fluid form pillars of proppant upon fracture closure.

5. The method of claim 4 wherein some or all of the slugs in the slugging step comprise a reinforcing material.

6. The method of claim 5 wherein the reinforcing material comprises organic, inorganic, or both organic and inorganic fibers, optionally with an adhesive coating alone or with an adhesive coating coated by a layer of non-adhesive substance dissolvable in the thickened fluid during its passage through the fracture; metallic particles of spherical or elongated shape; and plates, ribbons, and discs of organic or inorganic substances, ceramics, metals or metal alloys.

7. The method of claim 5 wherein the reinforcing material is included only in the proppant-carrying thickened fluid slugs.

8. The method of claim 5 wherein the reinforcing material elongated particles at least 2 mm long and having a diameter of from 3 to 200 microns.

9. The method of claim 5 wherein the proppant transport material comprises fibers at least 2 mm long and having a diameter of from 3 to 200 microns.

10. The method of claim 5 wherein the weight concentration of the reinforcing material or the proppant transport material in any slug is from 0.1 to 10%.

11. The method of claim 4 wherein some or all of the slugs in the slugging step further comprise a proppant transport material.

12. The method of claim 11 wherein the proppant transport material comprises a material comprising elongated particles having the ratio between their length and another dimension greater than 5 to 1.

13. The method of claim 12 wherein the proppant transport material is included only in the proppant-carrying thickened fluid slugs.

14. The method of claim 11 wherein the proppant transport material comprises fibers made from synthetic or naturally occurring organic materials, or glass, ceramic, carbon, or metal.

15. The method of claim 11 wherein proppant transport material comprises a material that becomes adhesive at formation temperatures.

16. The method of claim 15 wherein the proppant transport material is further coated by a non-adhesive material that dissolves in the thickened fluid as it passes through the fracture.

17. The method of claim 4 wherein the volume of the proppant-carrying thickened fluid is less than the volume of the thickened proppant-free fluid.

18. The method of claim 4 wherein the proppant comprises a mixture of proppant selected to minimize the resulting porosity of the proppant slugs in the fracture.

19. The method of claim 4 wherein the proppant particles have a resinous or adhesive coating alone, or a resinous or adhesive coating coated by a layer of non-adhesive substance dissolvable in the fracturing fluid as it passes through the fracture.

20. The method of claim 4 further comprising a tail-in-stage at an end of elements a) and b) comprising continuous introduction of proppant-carrying thickened fluid into the fracturing fluid, the proppant having an essentially uniform particle size.

21. The method of claim 20, wherein the proppant-carrying thickened fluid in the tail-in-stage further comprises a reinforcing material, a proppant transport material, or both.

22. The method of claim 4 wherein the fluids are thickened with a polymer or with a viscoelastic surfactant.

23. The method of claim 4 wherein the number of holes in each cluster are not the same.

24. The method of claim 23 wherein the orientations of the perforations in all the clusters relative to a preferred fracture plane are not the same.

25. The method of claim 4 wherein the diameter of holes in all clusters are not the same.

26. The method of claim 4 wherein the lengths of the perforation channels in all clusters are not the same.

27. The method of claim 4 wherein at least two different methods of perforating clusters are used.

28. The method of claim 27 wherein some of the clusters are produced using an underbalanced perforation technique.

29. The method of claim 27 wherein at least some of the clusters are produced using an overbalanced perforation technique.

30. The method of claim 4 wherein at least two clusters of perforations allow flow of a sequence of slugs of thickened proppant-free fluid and proppant-carrying thickened fluid are separated by a cluster of perforations having sufficiently small perforations that the proppant bridges and proppant-free fluid or substantially proppant-free fluid enters the formation through that cluster.

31. The method of claim 30 wherein every pair of perforations that produce a sequence of slugs of thickened proppant-free fluid and proppant-carrying thickened fluid are separated by a cluster of perforations having sufficiently small perforations that the proppant bridges and proppant-free fluid or substantially proppant-free fluid enters the formation through that cluster.

32. The method of claim 4 wherein the number of perforation clusters is between 2 and 300.

33. The method of claim 4 wherein the number of perforation clusters is between 2 and 100.

34. The method of claim 4 wherein the perforation cluster length is between 0.15 m and 3.0 m.

35. The method of claim 4 wherein the perforation cluster separation is from 0.30 m to 30 m.

36. The method of claim 4 wherein the perforation shot density is from 1 to 30 shots per 0.3 m.

37. The method of claim 4 wherein a fluid injection design is determined from a mathematical model.

38. The method of claim 37 wherein the fluid injection design includes a correction for slug dispersion.

39. The method of claim 4 wherein a perforation cluster design is determined from a mathematical model.

40. The method of claim 4 wherein at least one of the parameters slug volume, slug composition, proppant size, proppant concentration, number of holes per cluster, perforation cluster length, perforation cluster separation, perforation cluster orientation, and perforation cluster shot density, lengths of perforation channels, methods of perforation, the presence or concentration of reinforcing material, and the presence or concentration of proppant transport material is constant along the wellbore in the fracturing layer.

41. The method of claim 4 wherein at least one of the parameters slug volume, slug composition, proppant size, proppant concentration, number of holes per cluster, perforation cluster length, perforation cluster separation, perforation cluster orientation, and perforation cluster shot density, lengths of perforation channels, methods of perforation, the presence or concentration of reinforcing material, and the presence or concentration of proppant transport material increases or decreases along the wellbore in the fracturing layer.

42. The method of claim 4 wherein pillars of proppant are formed and placed such that the pillars do not extend an entire dimension of the fracture parallel to the wellbore but are themselves interrupted by channels so that the channels between the pillars form pathways that lead to the wellbore.

43. The method of claim 4 wherein the proppant slugs have a volume between 80 and 16,000 liters.

44. The method of claim 4 wherein the perforations are slots cut into tubing lining the wellbore.

* * * * *